US009819067B2

(12) United States Patent
Yang et al.

(10) Patent No.: US 9,819,067 B2
(45) Date of Patent: Nov. 14, 2017

(54) PLANAR-TRANSMISSION-LINE-TO-WAVEGUIDE ADAPTER

(71) Applicant: HUAWEI TECHNOLOGIES CO., LTD., Shenzhen (CN)

(72) Inventors: Bo Yang, Chengdu (CN); Hua Cai, Chengdu (CN); Guolong Huang, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/235,399

(22) Filed: Aug. 12, 2016

(65) Prior Publication Data

US 2016/0351988 A1 Dec. 1, 2016

Related U.S. Application Data

(63) Continuation of application No. PCT/CN2014/072096, filed on Feb. 14, 2014.

(51) Int. Cl.
*H01P 5/107* (2006.01)
*H01P 5/08* (2006.01)

(52) U.S. Cl.
CPC ..... *H01P 5/107* (2013.01); *H01P 5/08* (2013.01)

(58) Field of Classification Search
CPC ..... H01P 5/107; H01P 5/08
USPC ..... 333/24 R, 26
See application file for complete search history.

(56) References Cited

U.S. PATENT DOCUMENTS 7,486,156 B2 2/2009 Lee et al.
8,022,784 B2 * 9/2011 Lee ..... H01P 5/107 333/26
2012/0092091 A1 * 4/2012 Kang ..... H01P 3/123 333/239

OTHER PUBLICATIONS

International Search report dated Nov. 19, 2014 in corresponding International Application No. PCT/CN2014/072096.

* cited by examiner

*Primary Examiner* — Benny Lee
*Assistant Examiner* — Jorge Salazar, Jr.
(74) *Attorney, Agent, or Firm* — Staas & Halsey LLP

(57) ABSTRACT

A planar-transmission-line-to-waveguide adapter is provided, to reduce limitations on bandwidth expansion. The planar-transmission-line-to-waveguide adapter includes a planar transmission line structure includes at least a planar transmission line, a dielectric substrate, and a metal ground having a coupling gap. a gradient waveguide structure includes m dielectric waveguides with gradient sizes, and any dielectric waveguide is surrounded by metal via holes in a dielectric substrate, where m is a positive integer not less than 2. a1$^{st}$ dielectric waveguide in the m dielectric waveguides with gradient sizes is coupled with the coupling gap in the planar transmission line structure. Adjacent dielectric waveguides are connected by using a metal ground, and a radiation patch is disposed between the adjacent dielectric waveguides. A metal ground and a radiation patch are disposed on a surface on which an m$^{th}$ dielectric waveguide comes into contact with a standard waveguide.

15 Claims, 9 Drawing Sheets

PLANAR-TRANSMISSION-LINE-TO-WAVEGUIDE ADAPTER

CROSS-REFERENCE TO RELATED APPLICATIONS

This application is a continuation of International Application No. PCT/CN2014/072096, filed on Feb. 14, 2014, which is hereby incorporated by reference in its entirety.

TECHNICAL FIELD

The present invention relates to the field of communications technologies, and more specifically, to a planar-transmission-line-to-waveguide adapter.

BACKGROUND

A planar-transmission-line-to-waveguide adapter such as a stripline-to-waveguide adapter or a microstrip-to-waveguide adapter is an apparatus that implements a transition between a planar transmission line (a microstrip and a stripline are both planar transmission lines) and a circuit waveguide having a three-dimensional structure. The circuit waveguide having a three-dimensional structure is generally a standard waveguide, and a waveguide cavity is padded with no medium.

Bandwidth supported by a standard waveguide is generally wider, while bandwidth supported by a planar-transmission-line-to-waveguide adapter is generally narrower. Therefore, after the planar-transmission-line-to-waveguide adapter and the standard waveguide are used in a coordinative way, the planar-transmission-line-to-waveguide adapter becomes a bottleneck for bandwidth expansion.

SUMMARY

In view of this, an objective of embodiments of the present invention is to provide a planar-transmission-line-to-waveguide adapter, so as to reduce limitations on bandwidth expansion.

To achieve the objective, the embodiments of the present invention provide the following technical solutions:

According to a first aspect of the embodiments of the present invention, a planar-transmission-line-to-waveguide adapter is provided, including a planar transmission line structure and a gradient waveguide structure, where the planar transmission line structure includes at least a planar transmission line, a dielectric substrate, and a metal ground having a coupling gap, where the planar transmission line is located on a first surface of the dielectric substrate, and the metal ground having the coupling gap is located on a second surface of the dielectric substrate;

the gradient waveguide structure includes m dielectric waveguides with gradient sizes, where m is a positive integer not less than 2;

adjacent dielectric waveguides are connected by using a metal ground, and a radiation patch is disposed between the adjacent dielectric waveguides; and a $1^{st}$ dielectric waveguide in the m dielectric waveguides with gradient sizes is coupled with the coupling gap in the planar transmission line structure; and a metal ground and a radiation patch are disposed on a surface on which an $m^{th}$ dielectric waveguide comes into contact with a standard waveguide.

With reference to the first aspect, in a first possible implementation manner, a size of an $i^{th}$ dielectric waveguide is greater than a size of an $(i-1)^{th}$ dielectric waveguide.

With reference to the first aspect or the first possible implementation manner, in a second possible implementation manner, waveguide cavities of the m dielectric waveguides with gradient sizes are padded with a same dielectric material.

With reference to the first aspect or the first possible implementation manner, in a third possible implementation manner, waveguide cavities of the m dielectric waveguides with gradient sizes are padded with different dielectric materials, and a relative dielectric constant of a dielectric material with which a waveguide cavity of the $i^{th}$ dielectric waveguide is padded is less than a relative dielectric constant of a dielectric material with which a waveguide cavity of the $(i-1)^{th}$ dielectric waveguide is padded.

With reference to the first possible implementation manner of the first aspect, the second possible implementation manner of the first aspect, or the third possible implementation manner of the first aspect, in a fourth possible implementation manner, a size without a higher-order mode is used for the $1^{st}$ dielectric waveguide.

With reference to the third possible implementation manner of the first aspect, in a fifth possible implementation manner, a size without a higher-order mode is used for any dielectric waveguide.

With reference to the fourth or fifth possible implementation manner of the first aspect, in a sixth possible implementation manner, a ratio of a size without a higher-order mode used for a $j^{th}$ dielectric waveguide to a size of the standard waveguide is $1:\sqrt{\in_r^j}$, where $\in_r^j$ is a relative dielectric constant of a dielectric material with which a waveguide cavity of the $j^{th}$ dielectric waveguide is padded, and $1 \le j \le m$.

With reference to any one of the first aspect to the sixth possible implementation manner, in a seventh possible implementation manner, a size of the $m^{th}$ dielectric waveguide is less than or equal to the size of the standard waveguide.

With reference to any one of the seventh possible implementation manner of the first aspect, in an eighth possible implementation manner, a ratio of the size of the $m^{th}$ dielectric waveguide to the size of the standard waveguide is from 0.5 to 0.8.

With reference to any one of the first aspect to the eighth possible implementation manner, in a ninth possible implementation manner, the dielectric waveguide is surrounded by one layer of or more than one layer of metal via holes in the dielectric substrate.

With reference to the ninth possible implementation manner of the first aspect, in a tenth possible implementation manner, adjacent layers of metal via holes are distributed in a staggered way.

With reference to any one of the first aspect to the tenth possible implementation manner, in an eleventh possible implementation manner, a geometric center of any dielectric waveguide coincides with a geometric center of any radiation patch.

With reference to any one of the first aspect to the eleventh possible implementation manner, in a twelfth possible implementation manner, the planar-transmission-line-to-waveguide adapter is molded in one step by using a three-dimensional multi-chip assembly process.

It can be learned that the planar-transmission-line-to-waveguide adapter in the embodiments of the present invention includes m dielectric waveguides with gradient sizes.

The dielectric waveguides with gradient sizes can expand bandwidth for the planar-transmission-line-to-waveguide adapter, thereby reducing limitations of the planar-transmission-line-to-waveguide adapter on bandwidth expansion.

BRIEF DESCRIPTION OF DRAWINGS

To describe the technical solutions in the embodiments of the present invention more clearly, the following briefly describes the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

A stripline-to-waveguide adapter is substantially similar to a microstrip-to-waveguide adapter. The technical solutions provided by the embodiments of the present invention are described in this specification mainly by using a microstrip-to-waveguide adapter as an example.

Figure 1:
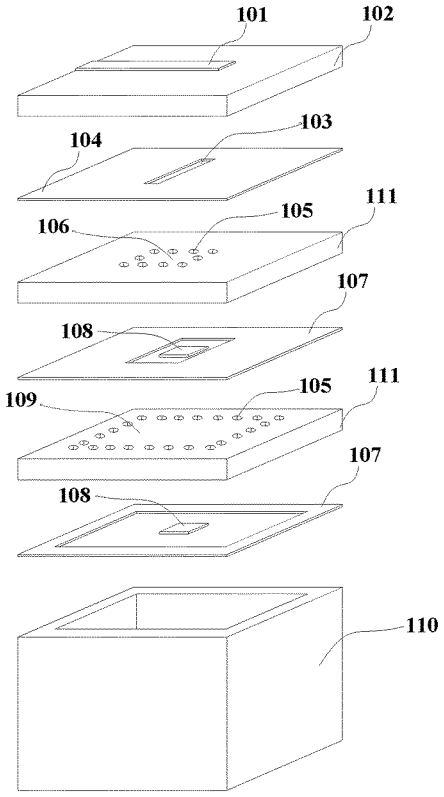
FIG. 1 is a schematic exploded diagram of layers of a microstrip-to-waveguide adapter according to an embodiment of the present invention.
Figure 2:
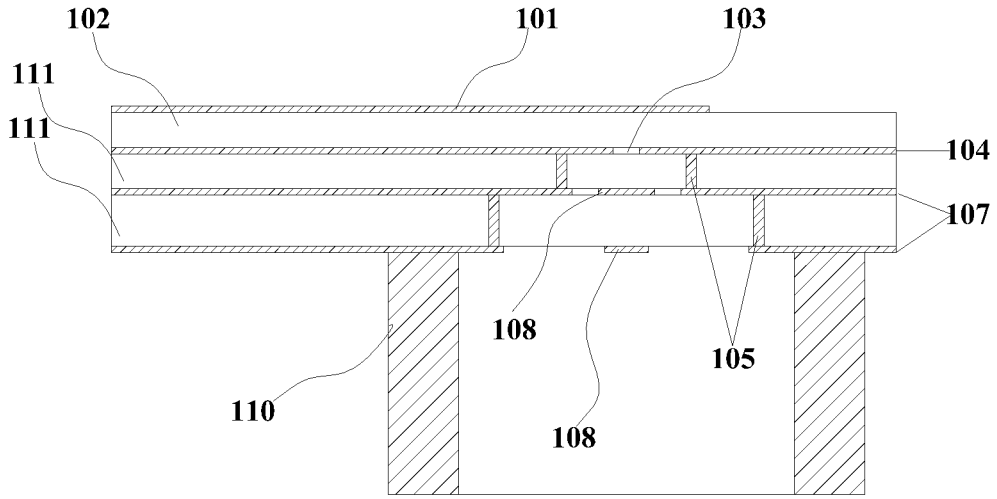
FIG. 2 is a zoom-in sectional view of the microstrip-to-waveguide adapter in FIG. 1.

FIG. 1 and FIG. 2 show a structure of a microstrip-to-waveguide adapter, which may include a planar transmission line structure and a gradient waveguide structure. For ease of understanding the structure of the microstrip-to-waveguide adapter, FIG. 1 shows layers of the microstrip-to-waveguide adapter in an exploded way, and FIG. 2 is a zoom-in sectional view of the microstrip-to-waveguide adapter in FIG. 1.

The planar transmission line structure includes at least a planar transmission line 101, a dielectric substrate 102, and a metal ground 104 having a coupling gap 103. In this embodiment, the planar transmission line 101 is specifically an open-circuited microstrip.

The planar transmission line 101 is located on a first surface of the dielectric substrate 102, and the metal ground 104 having the coupling gap 103 is located on a second surface of the dielectric substrate 102.

Figure 3:
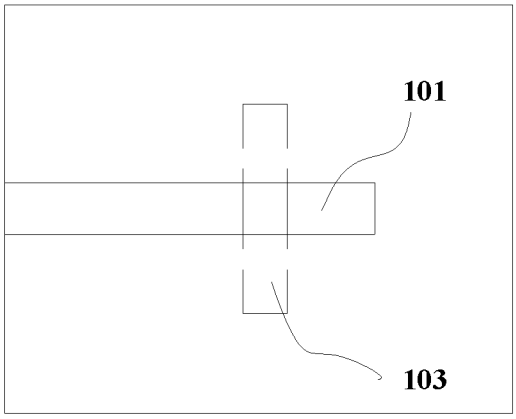
FIG. 3 is a structural top-view diagram of a planar transmission line structure according to an embodiment of the present invention.

For a top-view structure (zoomed in) of the planar transmission line structure, refer to FIG. 3.

The gradient waveguide structure may include m dielectric waveguides with gradient sizes (m is a positive integer not less than 2, and in this embodiment, m=2).

Any dielectric waveguide is surrounded by metal via holes 105 on a dielectric substrate 111.

Sizes of the m dielectric waveguides may be evenly gradient, or may be unevenly gradient, which is to be written in details later in this specification.

A $1^{st}$ dielectric waveguide (whose reference numeral is 106) in the m dielectric waveguides with gradient sizes is coupled with the coupling gap 103 in the metal ground 104 in the planar transmission line structure.

Adjacent dielectric waveguides are connected by using a metal ground 107, and a radiation patch 108 is disposed between the adjacent dielectric waveguides. Referring to FIG. 2, metal via holes 105 for different dielectric waveguides are connected by using the metal ground 107 between the dielectric waveguides.

A metal ground 107 and a radiation patch 108 are also disposed on a surface on which an $m^{th}$ dielectric waveguide (whose reference numeral is 109) comes into contact with a standard waveguide 110. In other words, a metal ground 107 and a radiation patch 108 are also disposed between the $m^{th}$ dielectric waveguide and a standard waveguide 110.

Figure 4:
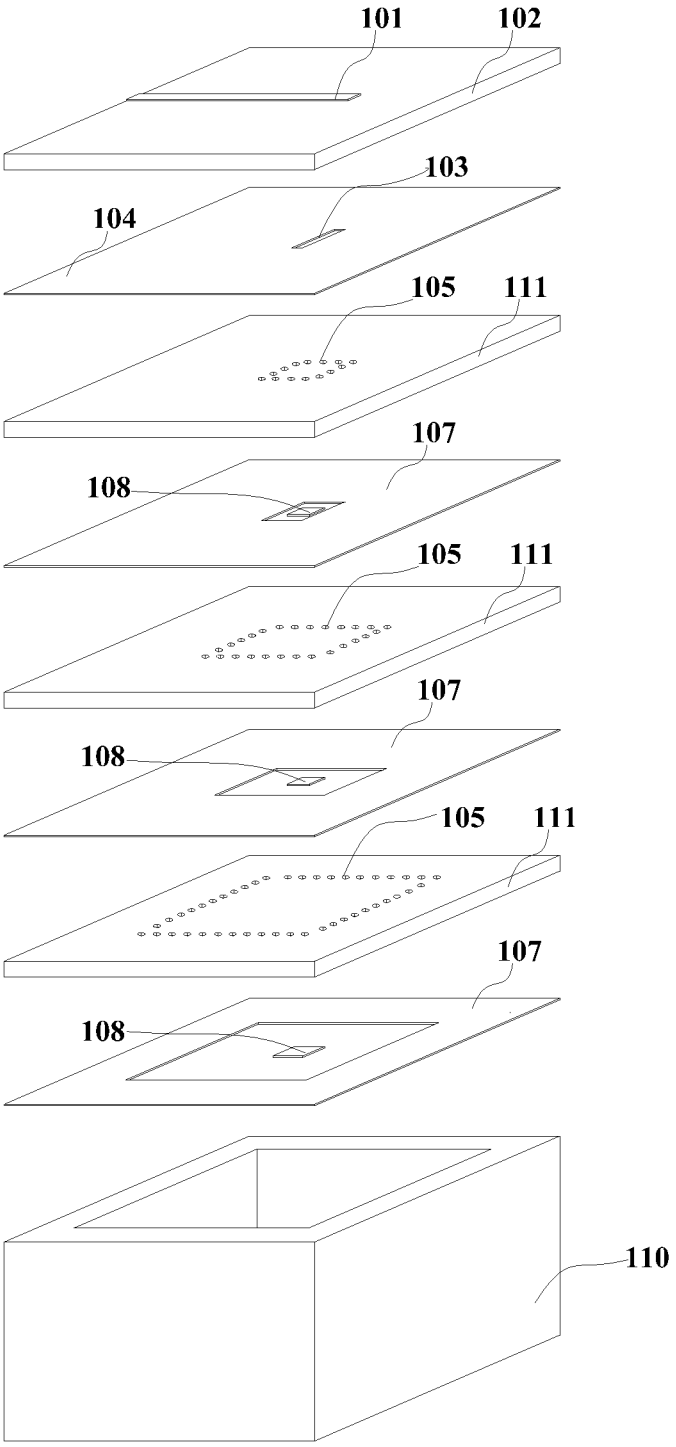
FIG. 4 is another schematic structural diagram of a microstrip-to-waveguide adapter according to an embodiment of the present invention.

Certainly, a quantity of dielectric waveguides is not limited to 2. Referring to FIG. 4, there may be three dielectric waveguides. Certainly, a person skilled in the art can design the quantity of dielectric waveguides flexibly according to a requirement, and no further details are described herein.

It can be learned that the planar-transmission-line-to-waveguide adapter in this embodiment of the present invention includes m dielectric waveguides with gradient sizes. The dielectric waveguides with gradient sizes can expand bandwidth for the planar-transmission-line-to-waveguide adapter, thereby reducing limitations of the planar-transmission-line-to-waveguide adapter on bandwidth expansion.

A working principle of the microstrip-to-waveguide adapter may be summarized as follows: A high-frequency signal is fed into the planar transmission line 101 (a microstrip) to form an electromagnetic field mode specific to the microstrip. A magnetic-field component is coupled to a lower dielectric waveguide cavity (an area surrounded by the metal via holes 105) by using the coupling gap 103 that is in the metal ground 104 and perpendicular to the planar transmission line 101. Then, a corresponding TE mode (TE means that an electric vector is perpendicular to a propagation direction) is excited, so that the coupled magnetic-field component is further coupled with the radiation patch 108 to cause an electromagnetic resonance and implement bandwidth impedance matching. Finally, an electromagnetic signal is fed into the standard waveguide 110. In this way, a transition of the high-frequency signal from the microstrip to the waveguide is implemented. The transition from the waveguide to the microstrip is an inverse of the foregoing process.

Figure 5:
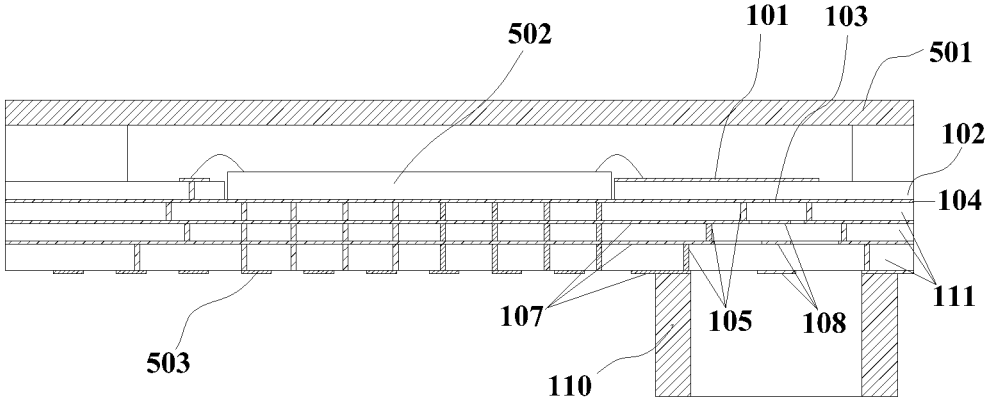
FIG. 5 is a schematic structural diagram of a millimeter-wave transceiver module according to an embodiment of the present invention.

FIG. 5 shows an application scenario of the microstrip-to-waveguide adapter. The microstrip-to-waveguide adapter may be used in a millimeter-wave transceiver module. In FIG. 5, a reference numeral 501 represents a module cover plate, a reference numeral 502 represents a millimeter-wave chip, and a reference numeral 503 represents a pin of the millimeter-wave transceiver module.

Figure 6:
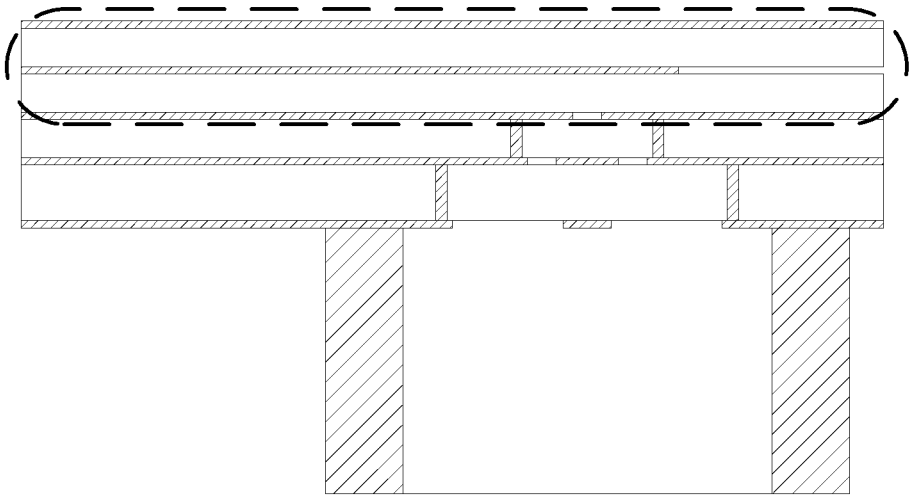
FIG. 6 is a schematic structural diagram of a stripline-to-waveguide adapter according to an embodiment of the present invention.

In addition, the microstrip and the stripline have very similar electromagnetic-field structures. FIG. 6 shows a structure of a stripline-to-waveguide adapter. In FIG. 6, an area surrounded by a dashed line is a stripline (a planar transmission line structure including a stripline), and other than that is a gradient waveguide structure.

A stripline is a planar transmission line with a closed structure. Therefore, compared with a microstrip-to-waveguide adapter, a stripline-to-waveguide adapter can reduce radiation losses brought by a microstrip and obtain better performance.

In another embodiment of the present invention, a geometric center of any dielectric waveguide in all the foregoing embodiments coincides with a geometric center of any radiation patch.

In another embodiment of the present invention, the planar-transmission-line-to-waveguide adapter is molded in one step by using a three-dimensional multi-chip assembly process. The three-dimensional multi-chip assembly process includes a multilayer printed circuit board process, a multilayer low-temperature co-fired ceramic process, a multilayer LCP (liquid crystal polymer) process, and the like.

During specific implementation, with the multilayer printed circuit board assembly process used as an example, an open-circuited microstrip (or stripline) is etched into one face of a PCB board whose two faces are coated with metal, and a coupling gap etched into another face, to obtain the planar transmission line structure.

Figure 7:
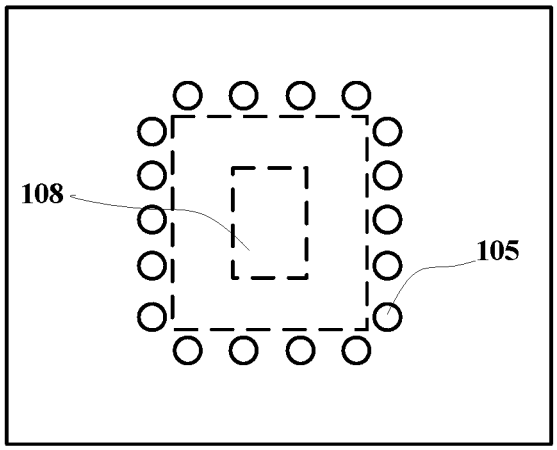
FIG. 7 shows a front-side structure of a PCB board whose two faces are coated with metal according to an embodiment of the present invention.
Figure 8:
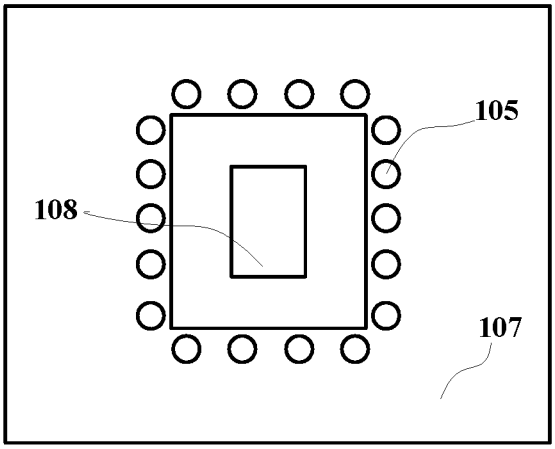
FIG. 8 shows a reverse-side structure of a PCB board whose two faces are coated with metal according to an embodiment of the present invention.

For a dielectric waveguide, still the multilayer circuit board process is used as an example. Metal via holes 105 may be disposed in a PCB board whose two faces are coated with metal, and a rectangular ring is etched into one face, to obtain the dielectric waveguide, a metal ground 107, and a radiation patch 108. FIG. 7 and FIG. 8 show front-side and reverse-side structures of a PCB board (a side facing a standard waveguide is viewed as the reverse side) whose two faces are coated with metal.

Figure 9:
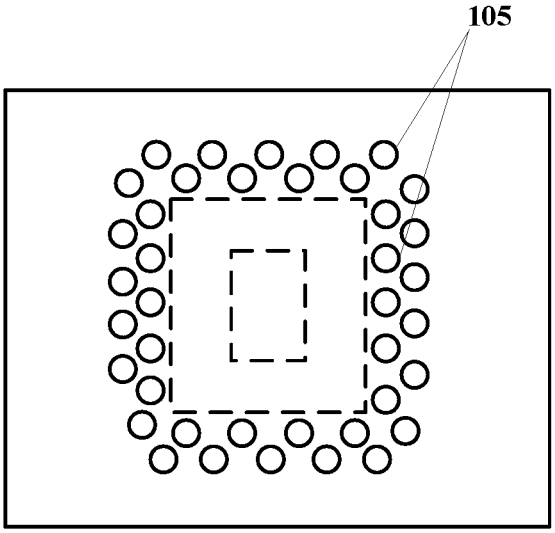
FIG. 9 is a schematic structural diagram of a dielectric waveguide according to an embodiment of the present invention.

To enhance a shielding effect of the dielectric waveguide surrounded by the metal via holes 105, the metal via holes 105 may, optionally, be arranged into a multilayer structure (as shown in FIG. 9). In other words, the dielectric waveguide is surrounded by multiple layers of metal via holes 105 on the dielectric substrate.

More specifically, adjacent layers of metal via holes 105 may be further distributed in a staggered way.

In addition, a metal via hole may be close to another metal via hole as much as possible, and a lower limit of a distance between metal via holes may be a shortest distance in a selected punching process.

It should be noted that a traditional microstrip-to-waveguide adapter implements a microstrip-to-waveguide transition by using a microstrip probe and a short-circuited back cavity of a waveguide.

However, the short-circuited back cavity of the waveguide needs to be formed by using a mechanical part. This results in a higher profile of the microstrip-to-waveguide adapter, increases complexity in structure, and increases production costs.

To overcome the problems of the traditional microstrip-to-waveguide adapter, the inventor finds a microstrip-to-waveguide adapter without a short-circuited back cavity during research and development of the present invention.

In the microstrip-to-waveguide adapter without a short-circuited back cavity, a coupling gap is used to couple a high-frequency signal to a standard waveguide from a microstrip, and a radiation patch is introduced to perform impedance matching. No short-circuited back cavity is used in this structure. Therefore, a profile of the microstrip-to-waveguide adapter is lowered.

However, because complex manual assembly is still required to implement the microstrip-to-waveguide adapter, very high process assurance is required. This, however, greatly limits applications of a high frequency, and in particular, applications of millimeter waves.

To resolve the problems of complex assembly and high process requirements, the inventor finds another adapter structure during research and development of the present invention. This adapter structure is designed in one step by using a multilayer PCB, LTCC, LCP or like process. In this structure, a coupling gap is still used to couple a high-frequency signal from a microstrip to a standard waveguide structure, and two radiation patches are used for matching of adapter impedance. In addition, in this adapter structure, metal via holes are used to surround a dielectric waveguide whose size is equivalent to a size of an externally connected standard metal waveguide.

Unlike a dielectric waveguide, a waveguide cavity of a standard waveguide is padded with no medium. In other words, a medium with which a waveguide cavity of a standard waveguide is padded is air. A waveguide cavity of a dielectric waveguide, on the contrary, is padded with a dielectric material capable of implementing a low microwave loss. For example, a relative dielectric constant of a medium used within the waveguide cavity of the standard waveguide is 1, while a relative dielectric constant of the dielectric material with which the waveguide cavity of the dielectric waveguide is padded may be 7.1. In other words, a dielectric waveguide cavity exists among a medium having a relatively high dielectric constant.

During research and development of the present invention, the inventor continues to find that, due to a relatively high dielectric constant, when interconnected with a standard metal waveguide that is in a main-mode working status, the dielectric waveguide is in a multi-mode working status. Therefore, even if there is only a relatively small alignment deviation between the adapter and the interconnected standard metal waveguide, a relatively large quantity of resonances will still be generated within a bandpass of the adapter, leading to relatively high instability.

To resolve the resonance problem, in another embodiment of the present invention, a size without a higher-order mode is used for the $1^{st}$ dielectric waveguide in the planar-transmission-line-to-waveguide adapter in all the foregoing embodiments.

Similarly, a ratio of the size without a higher-order mode to a size of a standard waveguide (inner wall) is $1/\sqrt{\in_r}$, where $\in_r$ is a relative dielectric constant of a dielectric material with which a waveguide cavity of the $1^{st}$ dielectric waveguide is padded.

Figure 10:
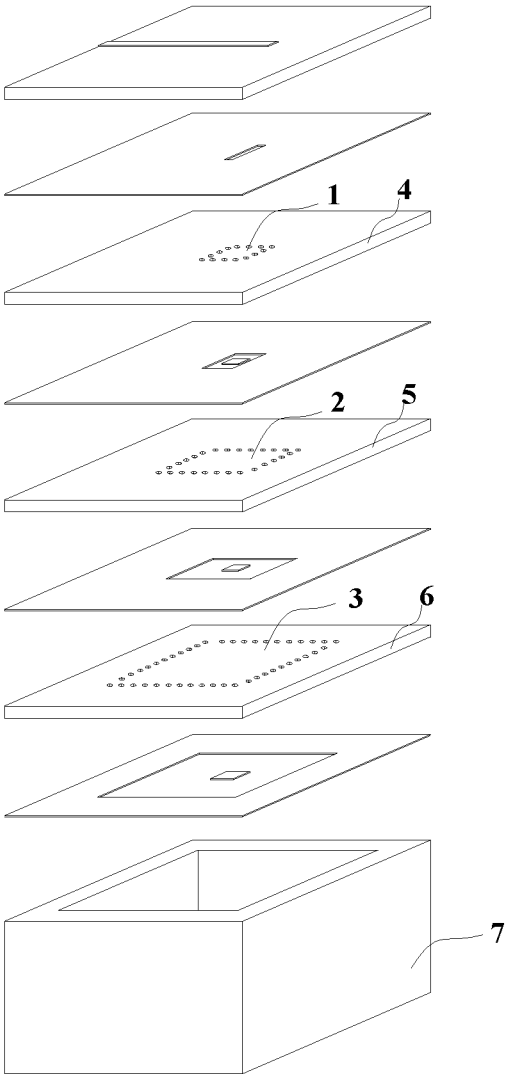
FIG. 10 is still another schematic structural diagram of a microstrip-to-waveguide adapter according to an embodiment of the present invention.

A microstrip-to-waveguide adapter including three dielectric waveguides is used as an example. Referring to FIG. 10, in the three dielectric waveguides, a reference numeral of a $1^{st}$ dielectric waveguide is 1, a reference numeral of a $2^{nd}$ dielectric waveguide is 2, and a reference numeral of a $3^{rd}$ dielectric waveguide is 3. The dielectric waveguide 1 is formed by disposing metal via holes in a dielectric substrate 4. The dielectric waveguide 2 is formed by disposing metal via holes in a dielectric substrate 5. The dielectric waveguide 3 is formed by disposing metal via holes in a dielectric substrate 6.

It is assumed that a relative dielectric constant of a dielectric material used by the dielectric substrate 4 is $\in_r^1$ (that is, the relative dielectric constant of the dielectric material with which a waveguide cavity of the dielectric waveguide 1 is padded is $\in_r^1$), that a relative dielectric constant of a dielectric material used by the dielectric substrate 5 is $\in_r^2$ (that is, the relative dielectric constant of the dielectric material with which a waveguide cavity of the dielectric waveguide 2 is padded is $\in_r^2$), and that a relative dielectric constant of a dielectric material used by the dielectric substrate 6 is $\in_r^3$ (that is, the relative dielectric constant of the dielectric material with which a waveguide cavity of the dielectric waveguide 3 is padded is $\in_r^3$).

A ratio of a size of the dielectric waveguide 1 to a size of the standard waveguide (inner wall) is approximate to 1: $\sqrt{\in_r^1}$.

Figure 11:
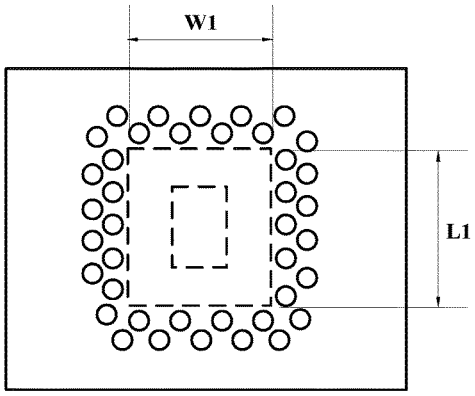
FIG. 11 is a schematic diagram of a size according to an embodiment of the present invention.

Unless specially stated, the size in all the embodiments of the present invention refers to a length and a width. That is, referring to FIG. 11, a ratio of a length L1 of the dielectric waveguide 1 to a length L of the inner wall of the standard waveguide is approximate to $1:\sqrt{\in_r^1}$, and a width W1 of the dielectric waveguide 1 to a width W of the inner wall of the standard waveguide is approximate to $1:\sqrt{\in_r^1}$.

In another embodiment of the present invention, waveguide cavities of the m dielectric waveguides with gradient sizes in all the foregoing embodiments may be padded with a same dielectric material. The microstrip-to-waveguide adapter including three dielectric waveguides shown in FIG. 10 is still used as an example, and then $\in_r^1=\in_r^2=\in_r^3$.

In another embodiment of the present invention, when a same dielectric material is used, sizes of the m dielectric waveguides in all the foregoing embodiments may be evenly gradient. That is, a size of an $i^{th}$ dielectric waveguide is greater than a size of an $(i-1)^{th}$ dielectric waveguide, a ratio of the size of the $i^{th}$ dielectric waveguide to the size of the $(i-1)^{th}$ dielectric waveguide is equal to a ratio of a size of an $(i+1)^{th}$ dielectric waveguide to the size of the $i^{th}$ dielectric waveguide, and $2 \le i \le m-1$.

For example, assuming that the ratio of the size of the $i^{th}$ dielectric waveguide to the size of the $(i-1)^{th}$ dielectric waveguide is equal to a, the ratio of the size of the $(i+1)^{th}$ dielectric waveguide to the size of the $i^{th}$ dielectric waveguide is also equal to a.

Certainly, when the same dielectric material is used, sizes of the m dielectric waveguides in all the foregoing embodiments may be unevenly gradient. In this case, that the size of the $i^{th}$ dielectric waveguide is greater than the size of the $(i-1)^{th}$ dielectric waveguide still needs to be ensured.

In another embodiment of the present invention, waveguide cavities of the m dielectric waveguides with gradient sizes in all the foregoing embodiments may be padded with different dielectric materials, and a relative dielectric constant of a dielectric material with which a waveguide cavity of the $i^{th}$ dielectric waveguide is padded is less than a relative dielectric constant of a dielectric material with which a waveguide cavity of the $(i-1)^{th}$ dielectric waveguide is padded.

The microstrip-to-waveguide adapter including three dielectric waveguides shown in FIG. 10 is still used as an example, and then $\in_r^1>\in_r^2>\in_r^3$.

In another embodiment of the present invention, when different dielectric materials are used, sizes of the m dielectric waveguides in all the foregoing embodiments may be evenly gradient. That is, a size of an $i^{th}$ dielectric waveguide is greater than a size of an $(i-1)^{th}$ dielectric waveguide, a ratio of the size of the $i^{th}$ dielectric waveguide to the size of the $(i-1)^{th}$ dielectric waveguide is equal to a ratio of a size of an $(i+1)^{th}$ dielectric waveguide to the size of the $i^{th}$ dielectric waveguide, and $2 \le i \le m-1$.

Alternatively, when different dielectric materials are used, a size without a higher-order mode is used for the m dielectric waveguides in all the foregoing embodiments.

A ratio of a size of a $j^{th}$ dielectric waveguide to a size of the standard waveguide (inner wall) is approximate to $1:\sqrt{\in_r^j}$ $(1 \le j \le m)$.

The microstrip-to-waveguide adapter including three dielectric waveguides shown in FIG. 10 is still used as an example. A ratio of the size of the dielectric waveguide 1 to the size of the standard waveguide (inner wall) is approximate to $1:\sqrt{\in_r^j}$. A ratio of the size of the dielectric waveguide 2 to the size of the standard waveguide (inner wall) is approximate to $1:\sqrt{\in_r^2}$. A ratio of the size of the dielectric waveguide 3 to the size of the standard waveguide (inner wall) is approximate to $1:\sqrt{\in_r^3}$. Because $\in_r^1>\in_r^2>\in_r^3$, the sizes of the dielectric waveguide 1 to the dielectric waveguide 3 gradually increase.

In another embodiment of the present invention, a size of an $m^{th}$ dielectric waveguide may be less than or equal to the size of the standard waveguide regardless of whether a same dielectric material is used.

More specifically, a ratio of the size of the $m^{th}$ dielectric waveguide to the size of the standard waveguide is from 0.5 to 0.8. Selection of this size is to ease a size conflict between a dielectric waveguide cavity and a standard waveguide cavity, so as to help impedance matching.

Figure 12:
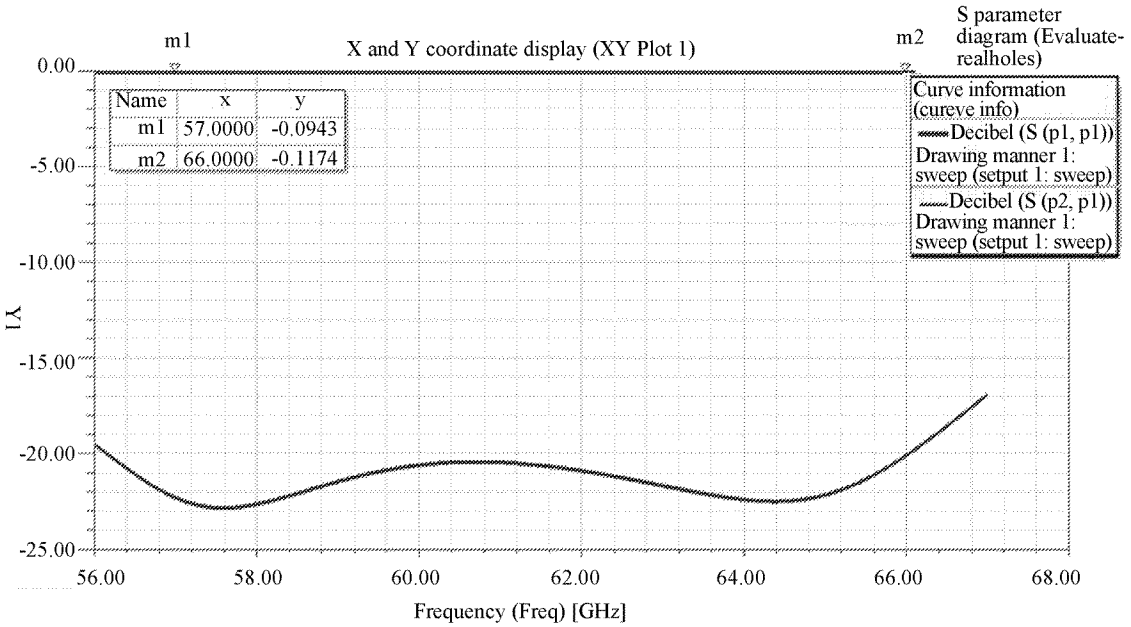
FIG. 12 is a simulation curve according to an embodiment of the present invention.

To verify effects of the technical solutions provided by the embodiments of the present invention, a microstrip-to-waveguide adapter including two dielectric waveguides is designed. A working frequency range of the adapter is 57 GHz to 66 GHz. A same dielectric material (a Dupont 9K7 material) is used for dielectric substrates in a planar transmission line structure and a gradient waveguide structure of the microstrip-to-waveguide adapter. A dielectric constant is 7.1. A thickness of the dielectric substrate is 0.11 mm. FIG. 12 is a simulation curve obtained when there is a deviation tolerance of 0.15 mm between the adapter and the standard waveguide. It can be learned, from the curve, that all frequency resonance points have been eliminated.

It can be learned that the introduction of the gradient waveguide structure inhibits a higher-order mode in the dielectric waveguide effectively. This reduces sensitivity of the planar-transmission-line-to-waveguide adapter to a deviation tolerance of the externally connected standard waveguide, eliminates resonances within a bandpass of the adapter, and improves performance of the adapter to a maximum degree. Therefore, the deviation tolerance existing with the connection to the standard waveguide has relatively high robustness, which reduces a difficulty in engineering implementation and improves performance of the entire adapter further.

In conclusion, the planar-transmission-line-to-waveguide adapter provided by this embodiment is an ultra wideband microstrip-to-waveguide adapter that has low process requirements and a low-profile structure. The planar-transmission-line-to-waveguide adapter can be applied to V-band communications, E-band communications, and other millimeter-wave ultra wideband communications very well, and can be well compatible with a millimeter-wave transceiver module. With this planar-transmission-line-to-waveguide adapter, a total set of solutions in which a millimeter-wave transceiver module with a waveguide interface is used can be easily developed.

The embodiments in this specification are all described in a progressive manner. Each embodiment focuses on what is different from other embodiments. For same or similar parts in the embodiments, mutual reference may be made.

It should be noted that in this specification, relational terms such as first and second are only used to distinguish one entity or operation from another, and do not necessarily require or imply that any such relationship or sequence actually exists between these entities or operations. Moreover, the terms "include", "comprise", or any of their variants is intended to cover a non-exclusive inclusion, so that a process, a method, an article, or an apparatus that includes a list of elements not only includes those elements but also includes other elements which are not expressly listed, or further includes elements inherent to such process, method, article, or apparatus. An element preceded by "includes a . . . " does not, without more constraints, preclude the existence of additional same elements in the process, method, article, or apparatus that includes the element.

The embodiments provided above are described to enable a person skilled in the art to implement or use the present invention. Various modifications to the embodiments are obvious to the person skilled in the art, and general principles defined in this specification may be implemented in other embodiments without departing from the spirit or scope of the present invention. Therefore, the present invention will not be limited to the embodiments described in this specification but expands to the widest scope in accordance with the principles and novelty provided in this specification.

What is claimed is:

1. A planar-transmission-line-to-waveguide adapter, comprising: a planar transmission line structure and a gradient waveguide structure, wherein the planar transmission line structure comprises at least a planar transmission line, a dielectric substrate, and a metal ground having a coupling gap, wherein the planar transmission line is located on a first surface of the dielectric substrate, and the metal ground having the coupling gap is located on a second surface of the dielectric substrate;

the gradient waveguide structure comprises m dielectric waveguides with gradient sizes increasing in a direction away from the planar transmission line, wherein m is a positive integer not less than 2;

adjacent dielectric waveguides among the m dielectric waveguides are connected by using a metal ground layer, and a respective radiation patch which is disposed between the adjacent dielectric waveguides; and a $1^{st}$ dielectric waveguide in the m dielectric waveguides is coupled with the coupling gap in the planar transmission line structure; and the metal ground layer and the radiation patch are disposed on a surface on which an $m^{th}$ dielectric waveguide among the m dielectric waveguides is contactable with a waveguide, wherein waveguide cavities of the m dielectric waveguides contain different dielectric materials.

2. The planar-transmission-line-to-waveguide adapter according to claim 1, wherein a size of an $i^{th}$ dielectric waveguide among the m dielectric waveguides is greater than a size of an $(i-1)^{th}$ dielectric waveguide among the m dielectric waveguides.

3. The planar-transmission-line-to-waveguide adapter according to claim 2, wherein a relative dielectric constant of a dielectric material in the waveguide cavity of the $i^{th}$ dielectric waveguide is less than a relative dielectric constant of a dielectric material in the waveguide cavity of the $(i-1)^{th}$ dielectric waveguide.

4. The planar-transmission-line-to-waveguide adapter according to claim 2, wherein a size which does not support a higher-order mode is used for the $1^{st}$ dielectric waveguide.

5. The planar-transmission-line-to-waveguide adapter according to claim 2, wherein a geometric center of any dielectric waveguide of the m dielectric waveguides coincides with a geometric center of the radiation patch.

6. The planar-transmission-line-to-waveguide adapter according to claim 2, wherein the planar-transmission-line-to-waveguide adapter is molded in one step by using a three-dimensional multi-chip assembly process.

7. The planar-transmission-line-to-waveguide adapter according to claim 1, wherein a size which does not support a higher-order mode is used for the $1^{st}$ dielectric waveguide.

8. The planar-transmission-line-to-waveguide adapter according to claim 7, wherein a ratio of a size which does not support a higher-order mode used for a $j^{th}$ dielectric waveguide among the m dielectric waveguides to a size of the waveguide is $1:\sqrt{\in_r^j}$, wherein $\in_r^j$ is a relative dielectric constant of a dielectric material in the waveguide cavity of the $j^{th}$ dielectric waveguide, and $1 \leq j \leq m$.

9. The planar-transmission-line-to-waveguide adapter according to claim 1, wherein a relative dielectric constant of a dielectric material in the waveguide cavity of an $i^{th}$ dielectric waveguide among the m dielectric waveguides is less than a relative dielectric constant of a dielectric material in the waveguide cavity of an $(i-1)^{th}$ dielectric waveguide among the m dielectric waveguides.

10. The planar-transmission-line-to-waveguide adapter according to claim 9, wherein a size which does not support a higher-order mode is used for any dielectric waveguide of the m dielectric waveguides.

11. The planar-transmission-line-to-waveguide adapter according to claim 1, wherein the planar-transmission-line-to-waveguide adapter is molded in one step by using a three-dimensional multi-chip assembly process.

12. The planar-transmission-line-to-waveguide adapter according to claim 1, wherein a size of the $m^{th}$ dielectric waveguide is less than or equal to the size of the waveguide.

13. The planar-transmission-line-to-waveguide adapter according to claim 12, wherein a ratio of the size of the $m^{th}$ dielectric waveguide to the size of the waveguide is from 0.5 to 0.8.

14. The planar-transmission-line-to-waveguide adapter according to claim 13, wherein the $m^{th}$ dielectric waveguide is surrounded by one layer of or more than one layer of metal via holes in the dielectric substrate.

15. The planar-transmission-line-to-waveguide adapter according to claim 1, wherein a geometric center of any dielectric waveguide of the m dielectric waveguides coincides with a geometric center of the radiation patch.

* * * * *